United States Patent [19]

O'Sheeran

[11] 3,953,949

[45] May 4, 1976

[54] PREFABRICATED, MODULAR BUILDING STRUCTURE

[76] Inventor: John H. O'Sheeran, Box 178, c/o Milwaukee Shell Corporation, Plum City, Wis. 54761

[22] Filed: Jan. 3, 1975

[21] Appl. No.: 538,245

[52] U.S. Cl. ..... 52/82; 52/237; 52/594; 52/758 D

[51] Int. Cl.[2] ..... E04B 7/08

[58] Field of Search ..... 52/82, 90, 92, 594, 52/758 D, 237; 210/163, 164

[56] References Cited

UNITED STATES PATENTS

| | | | |
|---|---|---|---|
| 490,301 | 1/1893 | Manson | 210/163 |
| 2,019,041 | 10/1935 | Bayley | 52/82 |
| 2,256,050 | 9/1941 | Hansen | 52/82 |
| 2,775,794 | 1/1957 | Keely | 52/82 |
| 2,820,990 | 1/1958 | Johnson | 52/82 |
| 2,874,651 | 2/1959 | Peterson | 52/82 |
| 3,236,014 | 2/1966 | Edgar | 52/92 |
| 3,338,005 | 8/1967 | Gelsavage | 52/82 |
| 3,632,149 | 1/1972 | Konig | 52/758 D |
| 3,771,277 | 11/1973 | Rausch | 52/90 |

FOREIGN PATENTS OR APPLICATIONS

| | | | |
|---|---|---|---|
| 599,793 | 3/1948 | United Kingdom | 52/90 |
| 812,671 | 4/1959 | United Kingdom | 52/594 |

*Primary Examiner*—Ernest R. Purser
*Assistant Examiner*—Henry Raduazo
*Attorney, Agent, or Firm*—Sughrue, Rothwell, Mion, Zinn & Macpeak

[57] ABSTRACT

A prefabricated building structure of teepee form is constructed of prefabricated, cored panels and assembled on the site through the use of interlocking connections at the peripheral extremities of a floor panel assembiy. The building structure may be set up by assembling the floor, placing side panels thereon and inclined thereto, connecting the sides of the side panels by corner beams and affixing a monolithic cap to the base assembly by a rod threadedly coupled at opposed ends to the cap and base assembly respectively.

13 Claims, 11 Drawing Figures

4C
4C

Fig-8A
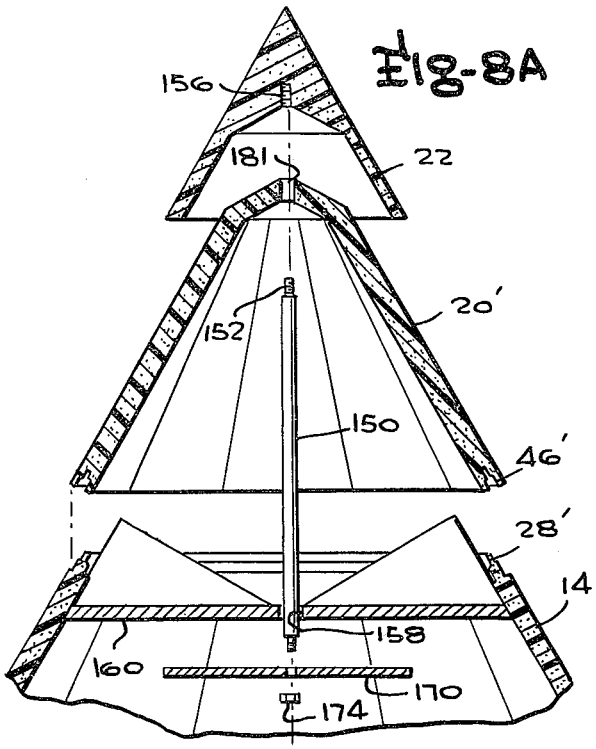
Fig-9
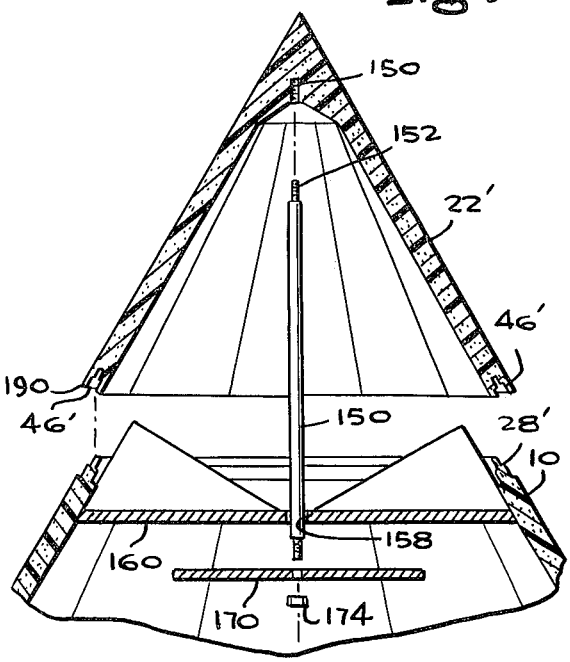
Fig-8B
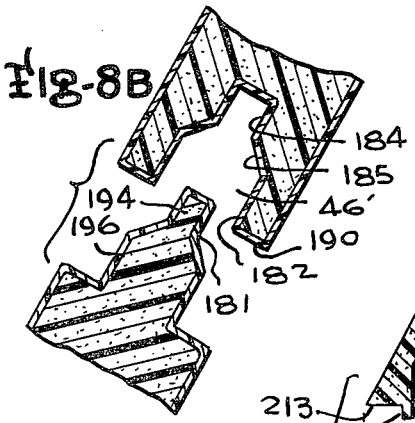
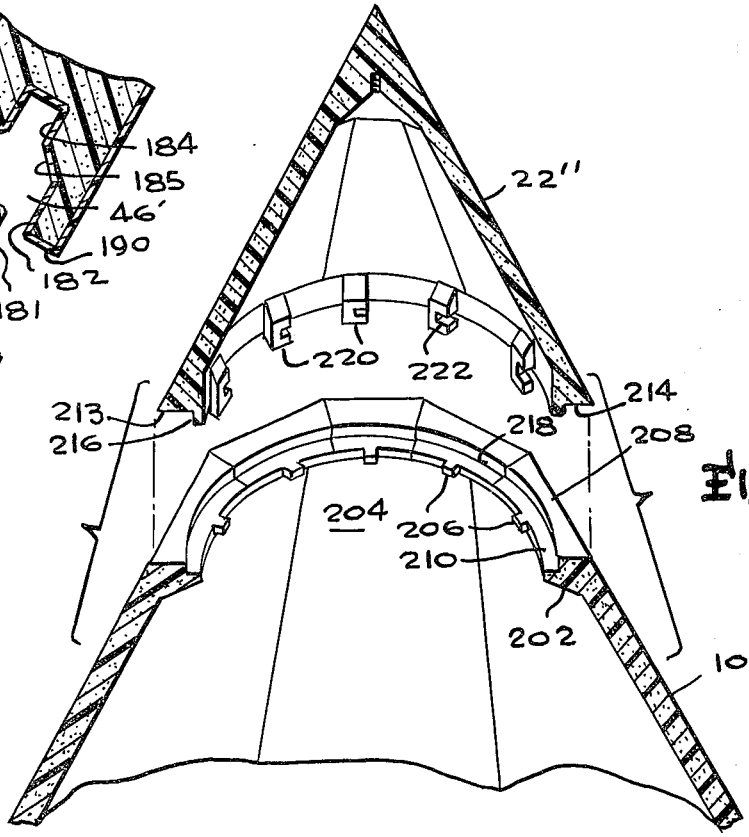
Fig-10

PREFABRICATED, MODULAR BUILDING STRUCTURE

BACKGROUND OF THE INVENTION

1. Field of the Invention

This invention relates to building structures in general and more particularly to a building structure of the teepee type in which cored structural panels in modular form are interlocked to form the floor, sidewalls, and cap of the teepee.

2. Description of the Prior Art

Building structures formed of unitary panels which are manufactured remote from the site of erection of the building are now common in the building industry. However, the assembly of the prefabricated panels or modular units such as sidewalls, roof trusses and the like, on the site is achieved, at least partially, by conventional building techniques, and the assembly of the modular units is difficult in terms of those portions of the building which are completed by the conventional building techniques.

SUMMARY OF THE INVENTION

The present invention embodies the formation of a completed site erected building through the use of prefabricated cored components in the form of floor panels, sidewall panels, a cap in either monolithic or multiple panel form and prefabricated corner and floor beams. In this respect, each of the structural components of the building are formed with an outer layer of rigid plastic; resin impregnated, fiberglass material, and preferably, a core of polyurethane foam to provide a component which is of high rigidity, weatherproofness and waterproofness to withstand atmospheric conditions, but which is relatively light in weight and wherein, the polyurethane foam core acts as a thermal insulator. The components thus require minimum site preparation, may be manufactured remote from the site, may be readily transported thereto for assembly by non-skilled labor.

An important objective of the present invention resides in the utilization of a unique fastening system for the components which include mated male and female connector portions, particularly designed for compatability with the materials employed in creating the structure components.

The manner of assembly permits ready dis-assembly, when necessary, and the units may incorporate integrated accessory features such as wiring and plumbing at their point of manufacture to permit on site electrical and mechanical connections between the accessory units of adjacent panels.

Other and further objects and advantages of the invention will become apparent to those skilled in the art from a consideration of the following specification where read in conjunction with the annexed drawings.

BRIEF DESCRIPTION OF THE DRAWINGS

FIG. 4 is a perspective view of an alternate form of floor assembly for the building structure of FIG. 1.

FIG. 8 is an exploded, sectional view similar to that of FIG. 7 showing an alternate embodiment of the present invention.

FIG. 9 is an exploded, sectional view similar to that of FIGS. 7 and 8 of yet another embodiment of the present invention.

FIG. 10 is an exploded perspective view of an alternate embodiment of the invention showing the attachment of the cap to the base assembly.

DESCRIPTION OF THE PREFERRED EMBODIMENTS

Figure 1:
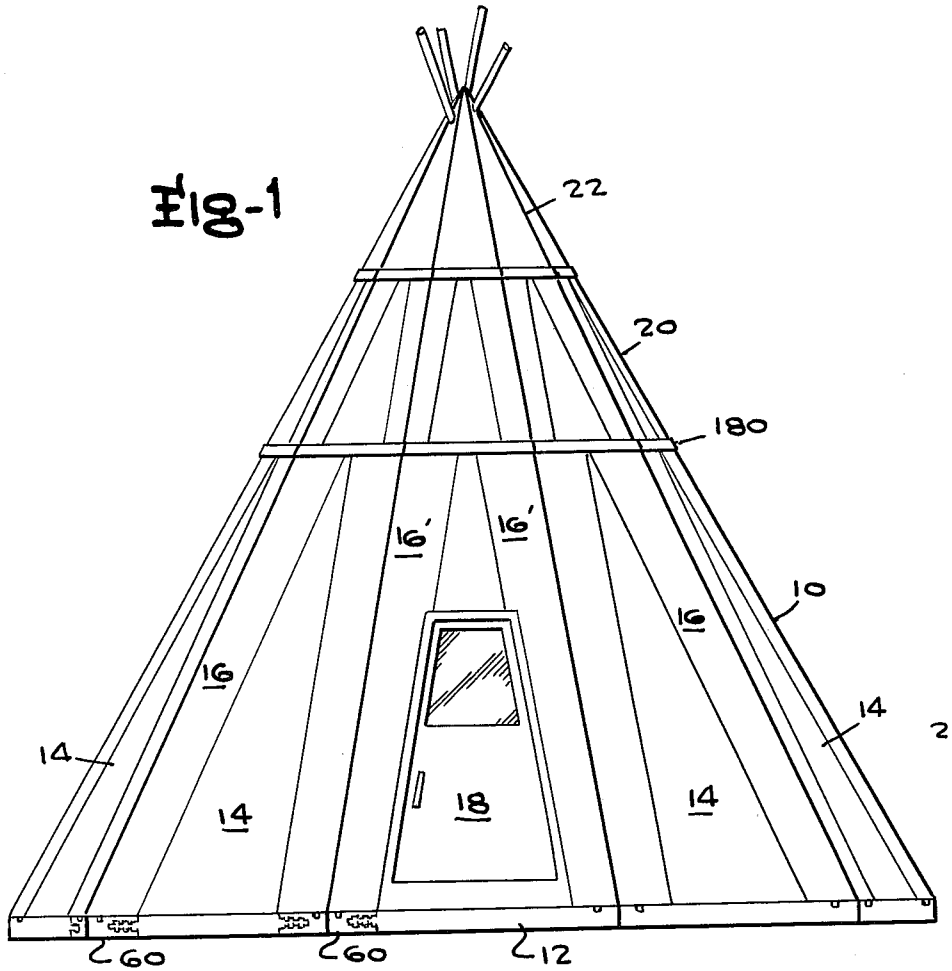
FIG. 1 is a front elevational view of a building structure of teepee form comprising one embodiment of the present invention.

Referring to the drawings, FIG. 1 illustrates as an example, one embodiment of the present invention in which the building structure comprises a housing unit of teepee form consisting essentially of a base assembly 10 including a floor assembly 12, triangular sidewall panels 14 whose lateral edges are coupled together by corner beams 16. The building structure includes within base assembly 10, a door 18 which fills a space between two corner beams 16' in much the same manner as side panels 14. On top of base assembly 10, there is provided an intermediate or second stage shell 20 of tapering form as an extension of base assembly 10, and the building structure is completed by a monolithic cap 22. Means described hereinafter affixes the monolithic cap to the base assembly 10, by capturing the second stage shell 20 therebetween.

Figure 2:
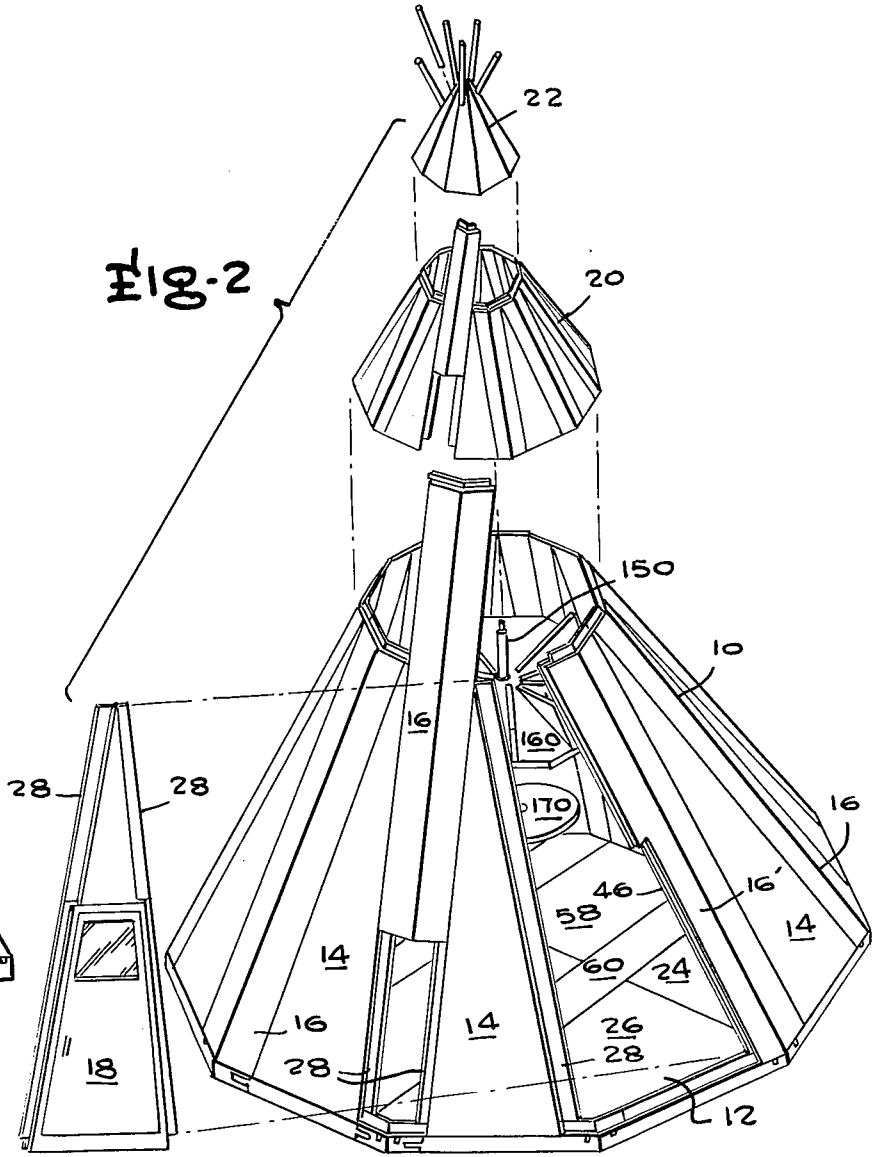
FIG. 2 is an exploded, perspective view of the principal structural components of the building structure of FIG. 1, illustrating the method of assembly thereof.

The general make-up of the modular unit or components forming the building structure of FIG. 1, as well as the other embodiments of the invention, may be more clearly seen in the exploded perspective view of FIG. 2. The teepee type of building structure of the present invention in all embodiments constitutes essentially a regular pyramid as defined by a floor which constitutes a regular ten sided polygon and whose sides extend upwardly and inwardly from the floor 12 to the cap 22. Therefore, essentially the base assembly 10 constitutes a frustrum of a regular pyramid as does the second stage shell 20, while the monolithic cap 22 is in essence a small pyramid.

Figure 3A:
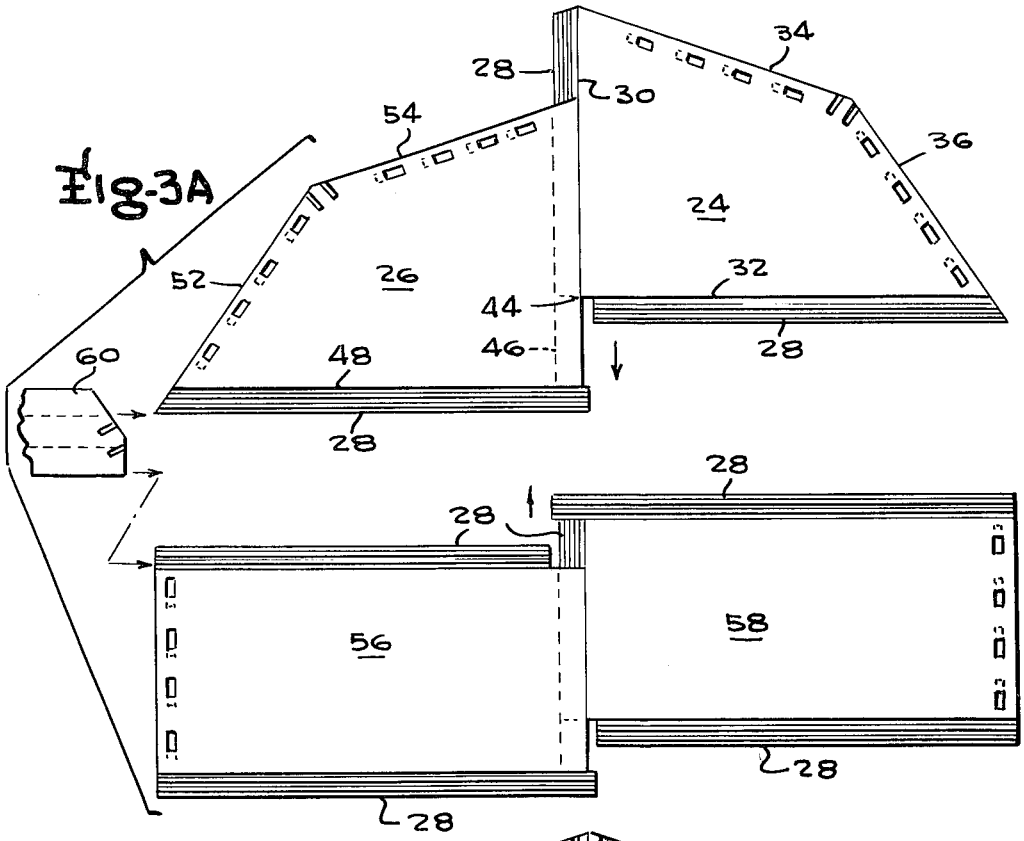
FIG. 3 is a plan view, partially broken away, of a typical floor assembly for the building structure of FIG. 1.
Figure 3B:
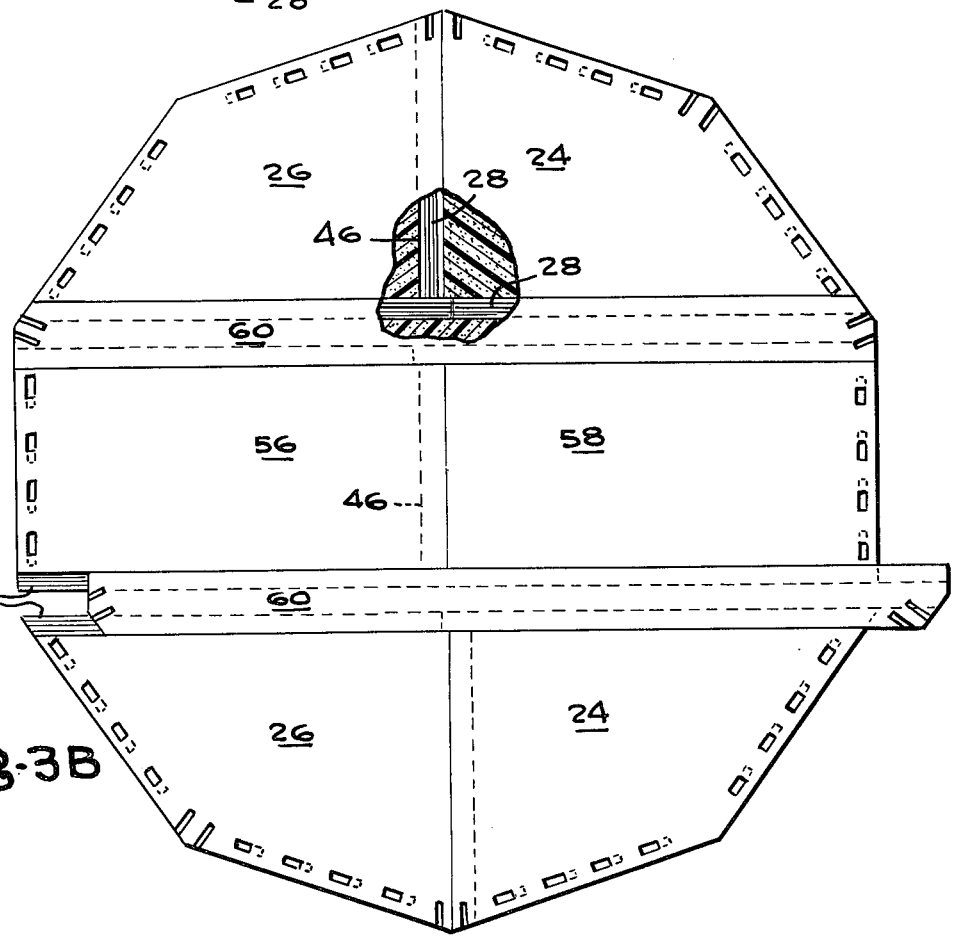

Reference to FIG. 3 shows one form of the floor assembly 12 which is comprised of six floor panels. Two outer floor panel sets are arranged on opposite sides of an inner floor panel set and are connected thereto by interposed connectors, as appears below. Each set of outer floor panels comprises a male panel 24 and a female panel 26, the male panel being provided with male connectors 28 along both right angle edges 30 and 32, being completed by angled edges 34 and 36. Edges 34 and 36 are slotted as at 38 to permit reception of side panel connectors 40 which, in turn, support inclined side panels 14, FIG. 5. Panels 24 and 26 are quadrilateral in form and the distinction between panel 24 and 26 resides in the fact that the edge 44 of panel 26 terminates in a female connector 46 which receives the male connector 28 of panel 24 as shown. In lile manner, edge 48 which is at right angles to edge 44 of floor panel 26 terminates in a male connector 28 and floor panel 26 further includes peripheral edges 52 and 54 corresponding to edges 34 and 36 of panel 24. The floor panels 24 and 26 define sets which occupy positions to either side of a set of inner floor panels 56 and 58. Panels 56 and 58 are provided, at opposed ends, with female and male connectors 46 and 28 respectively, and incorporate, at their longitudinal side edges male connectors 28 in similar fashion to that of the outer floor panel sets. Mechanical connection is made therebetween by the employment of floor beams 60 which incorporate female connectors 46 at both side edges and which slidably receive the male connectors 28 of both the inner floor panel and outer floor panel sets as shown. Thus, the completed construction of the floor assembly 12 is achieved in an interlocking manner.

Turning next to FIG. 4, an alternate floor assembly 12' is illustrated whose outer periphery again constitutes a regular ten sided polygon and which permit mounting of the side panels and corner beams to the outer edge of the floor assembly in the same manner as the prior embodiment of FIG. 3. In this respect, four arcuate panels 61 have slots 62 at both ends 64 to form female connectors. The arcuate panels 61 are connected together by beams 66 whose sides comprise male connector 68 received within slots 62 of the arcuate panels 61. The beams 66 and arcuate panels 61, when connected define an annulus with a circular hole 70 within the center of the same and the beams 66 and panels 60 terminate at their inner ends in a ledge 72 which is slotted at 74 at circumferentially spaced positions so as to receive the shoe or bayonet member 76 of a floor insert disc or panel 78. Panel 78 is of a diameter corresponding to the inside of ledge 72. The bayonets or shoes 76 are L-shaped in configuration and depend from the bottom of the insert disc 78. Slots 74, are enlarged circumferentially as at 74' to receive the horizontal extension portion 76' of the shoe as the disc 78 is rotated counterclockwise in FIG. 1, after the shoes 76 are inserted within respective slots 74. In that regard, a special T-shaped turning tool 80 consisting of a base or handle 82 and a right angle projection 84 is employed such that projection 84 fits within rectangular opening 86 within the center of the disc 78 corresponding thereto, whereby sufficient force may be exerted to rotate the disc 78 counterclockwise for coupling and clockwise for uncoupling the floor insert disc with respect to that section of floor assembly 12' receiving the same. Further, there is provided a locking pin 88 at each slot location and the pins are received within the same slots 74 as the shoes 76 and fill the space left by the shoes 76 to rigidly couple the floor insert disc to the surrounding portion of the floor portion assembly 12'. Thus, the floor panels 60 are interlocked by four beams 66 and this provides a concentric support for the floor insert disc 78. After the disc is dropped into place, such that the fall within slots 74, and it is rotated counterclockwise to lock the shoes 76 within locking slots 74, the insertion of locking pins 88 prevent retrograde movement and removal of the insert disc 78 from the assembly 12'.

Figure 5A:
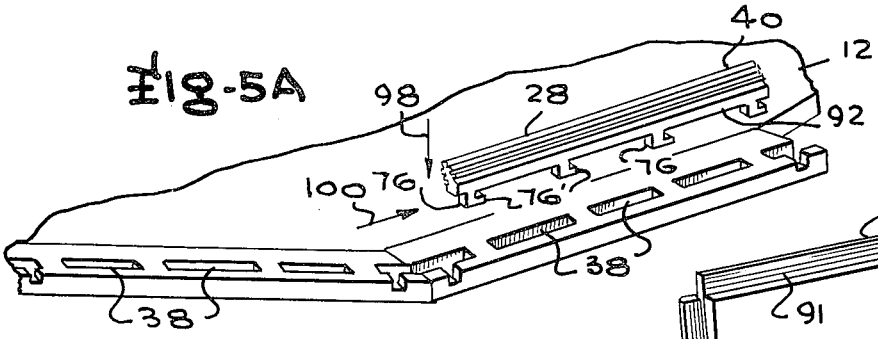
FIG. 5 is a perspective view of a portion of the base assembly of the building structure of FIG. 1 showing the method of assembly of the side panel of the teepee base assembly.
Figure 5B:
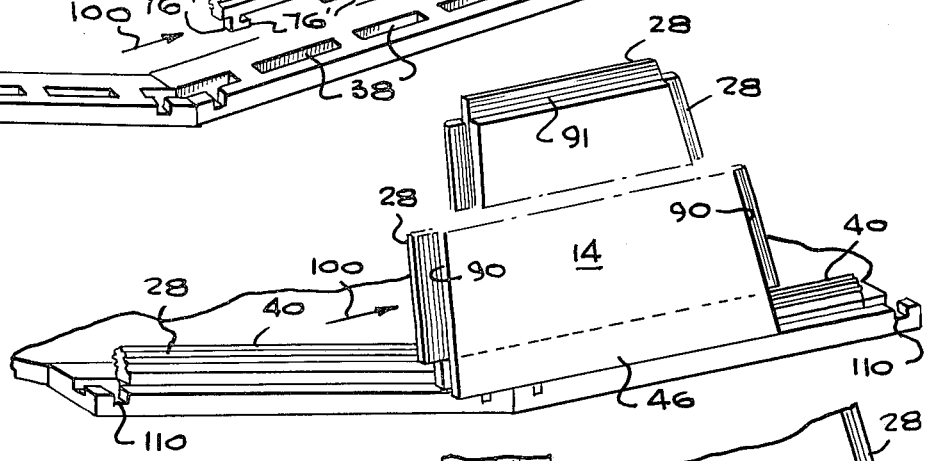
Figure 5C:
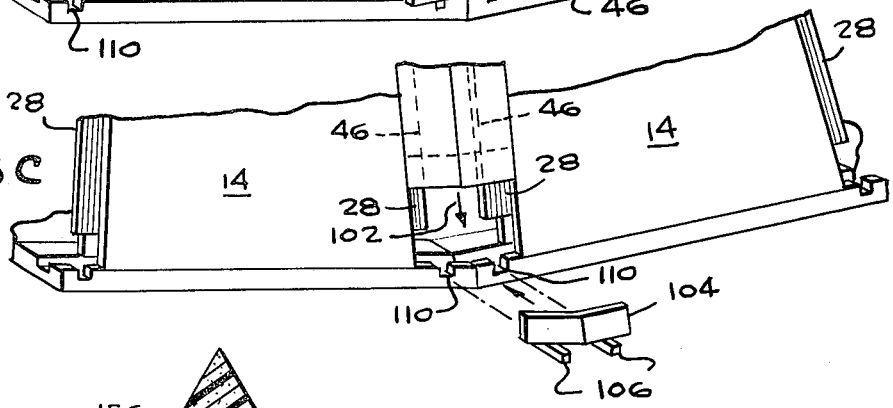

With respect to both the embodiment of FIG. 3 and the embodiment of FIG. 4, the outer periphery of the floor assemblies are provided with rectangular holes or slots 38 which function as receptacles for the side panel connectors 40 which in turn support respective inclined side panels 14 of base assembly 10. Reference to FIG. 5 shows more clearly this portion of the base assembly and its manner of construction. Each of the panels 14 is in the form of a trapezoid, that is, the sides 90 taper inwardly from the bottom to the top, the side panel 14 terminates at both side edges 90 and at the top edge 91 in a male connector 28, the bottom edge is provided with a slot forming a female connector 46 corresponding essentially to the male and female connectors associated with the panels of the floor assembly 12 and 12'. Each side panel connector 40 constitutes an elongated member which may preferably be extruded of plastic, consisting of a horizontal base portion 92 and having integrally molded therewith and supported on the base section 92, a male connector 28 of appropriate surface configuration for mating within female connector 46 at the bottom edge 88 of the side panel receiving the same. In order to permit locking of the side panel connector 40 to the building structure floor assembly 12 or 12', there are provided a plurality of depending shoes or bayonet members 76 which are identical in size and configuration to the shoes 76 on the floor insert disc 78. In this respect, the slots 38 of the floor assembly 12 or 12' which receive the same, are identically configured to the slots 74 in FIG. 4 and terminate in circumferential slot extensions receiving the head 76' of the shoe 76 to lock the same against vertical removal once the side panel connector shoe is inserted in the direction of arrow 98 and then slid horizontally as indicated by arrow 100. Coupling of adjacent side panels 14 is achieved by the use of angled corner beams 16 or 16' which are again dropped into place vertically as indicated by arrow 102, the corner beam being provided with female connectors 46 at each longitudinal edge which receive the male connectors 28 of side panels 14 during such movement in a manner similar to a tenon and slot connection, conventional to woodworking.

Preferably, prior to sliding the corner beam in place to rigidly connect the side panels together, a corner plug 104 which is angled similar to the corner beam 16 and which has a pair of mounting bars 106 extending at right angles to the angled portions 108 of the corner plug, are slid into lateral grooves 110 within the upper surfaces of the floor assembly 12 at its periphery to effect increased rigidity to the completed assembled base assembly 10. It is noted in FIGS. 1 and 2, that two of the corner posts, as at 16', are modified so as to permit the mounting of door 18 within the lower half of the base assembly 10 just above the floor assembly 12. A short triangular panel 112 is mounted above the door 18 and fixed respectively to modified corner beams 16' by the same side edge interlocking connection between appropriate male and female connectors 28, and 46, respectively. The total configuration of the panel which contains the door is atypical in that the lower portion of the triangular door panel 18 has foreshortened male connectors on the vertical edges of the door. With the subassembly of the door panel complete, the panel slides into place in a conventional fashion. Further, the inclined corner beams 16' for mounting the door panel have an atypical shape wherein the configuration of the inclined corner beams 16' accommodates the foreshortened male connectors on the edges of the inclined door panel. The lower frustoconical base assembly may be readily applied as the basic construction unit with a variety of upper terminal structures described in detail hereinafter.

Figures 4A, 4B, 4C, 6:
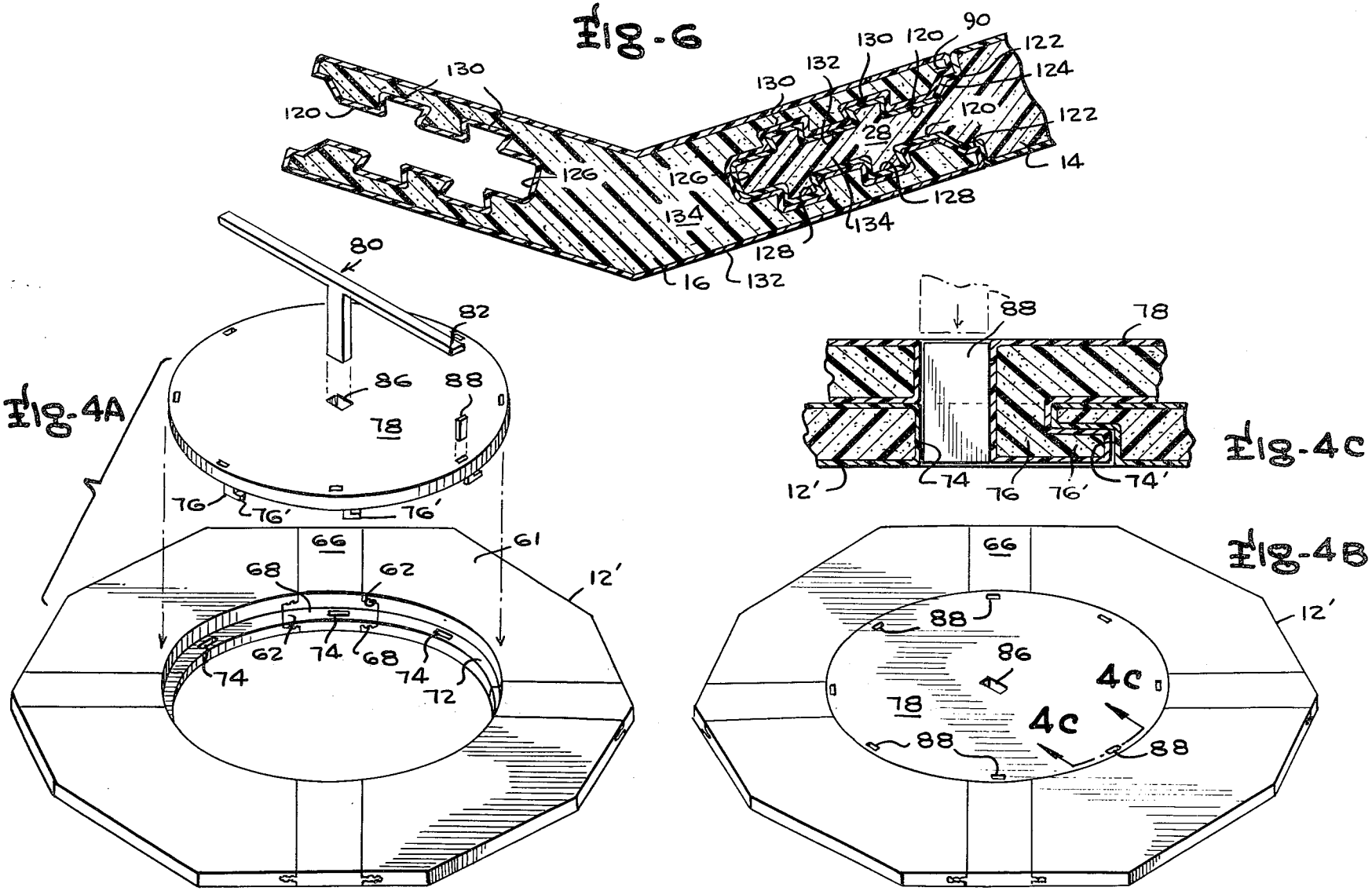
FIG. 6 is a sectional view of one corner of the base assembly of FIG. 5 showing the typical male and female connection between an angled corner beam and a side panel, making up that assembly.

The coupling between male and female connectors and their construction as employed throughout the building structure may be best seen by reference to FIG. 6 which is a cross section of an angled corner beam 16 and a portion of a side panel 14. In this respect, the angled corner beam 16 terminates in a slot configuration which extends inwardly from edge 118 formed by opposing sidewalls 120 having an initial flat entry portion 122 converging wall portions 124 and in terminating at their inner ends at end wall 126. Opposed keystone shaped longitudinal slots or grooves 128 within said walls 120 create the mechanical interlocking means between the female connector 46 and the male connector 28 received thereby. With respect to side panel 14 extending outwardly from the edge 90 is the male connector 28 which includes multiple keystone shaped ribs 130 on either side thereof which are received within slots 128 and effect the desired interconnection between the male and female connectors to prevent lateral separation between the angled corner beam 16 and the side panels 14, when used in this manner. The rigid surface 132 and the foamed polyurethane core 134 of both members may be readily seen in the sectional view of FIG. 6. While the connectors 28 and 46 are shown as being integral with the panels, they may in fact be separately made and secured to the side edges of the panels by mastic bond or the like. Further, while the male connectors 28 are shown as extending essentially the full length of both sides of the side panels as well as across the top, they may extend only partially along these edges and be made up in sectional form as desired. Further, while the grooves or slots 128 of the corner beams 16 are shown as being keystone shaped in cross section as are the matching ribs or projections 130 of the male connector 28, these slots and the projections received thereby may take other forms as desired. The components are joined in sidewise, sliding fashion with the keystone projections being actively engaged within the keystone slot or groove of the female connector 44 and when thus joined the end wall 118 of the angled corner beam abuts the sides 90 of the side panels 14 to produce a joint which is waterproof and is highly resistant to the passage of any fluid in either liquid or gaseous form therebetween.

Figure 7:
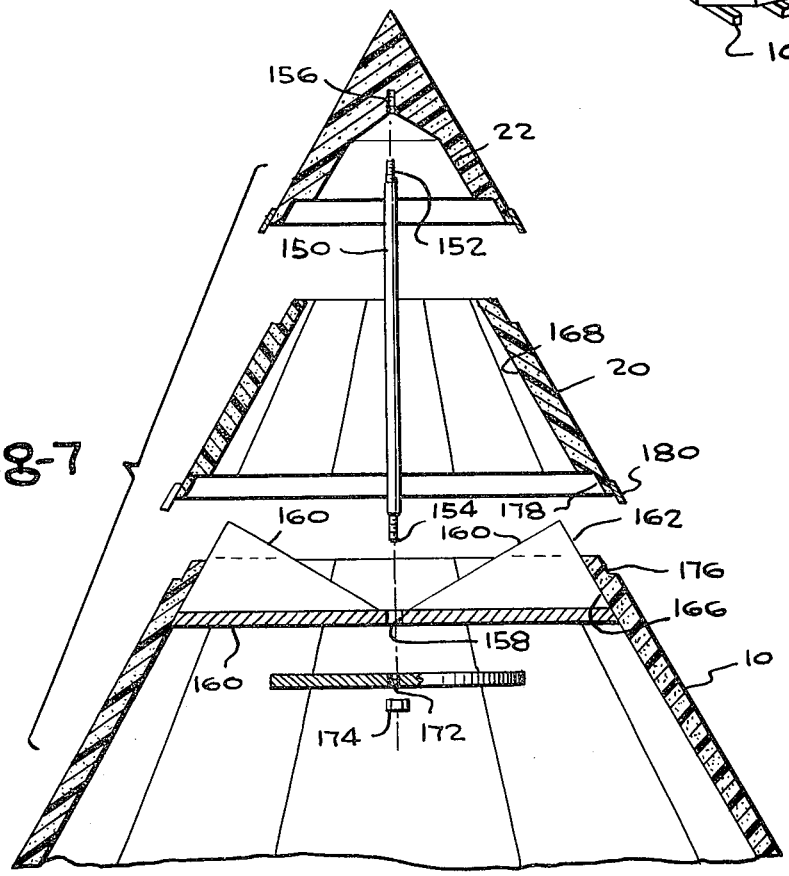
FIG. 7 is an exploded, sectional view of a portion of the building structure of FIG. 1 illustrating the method of assembly of the cap, second stage shell and base assembly.

Reference to FIG. 7 discloses one embodiment of the present invention in which the building structure is completed by attaching to the base assembly 10, the intermediate or second stage shell 20 by mechanically coupling the monolithic cap 22 to the base assembly 10. In this respect, a fiberglass rod 150 having oppositely threaded ends 152 and 154, passes through the center of a unitary second stage shell 20 with threaded end 152 received within a threaded hole 156 of cap 22. The other threaded end 154 of the rod passes through an opening 158 within a ceiling disc 160 which is provided with a plurality of circumferentially spaced fins or webs 160 projecting upwardly therefrom and having side edges 162, which contact the inner surface 166 of the side panels 14 or corner beams 16 and additionally contact the inner surface 168 of the second stage shell 20 and assist in aligning these parts during assembly. Assembly is completed through the use of ceiling plate 170 which is threaded at 172 and a lock nut both of which threadably receive the threaded end 154 of the fiberglass rod 150. The outer edges of the sidewalls 14 at their upper ends are recessed as at 176 while the lower edges of the second stage shell are recessed on the inside surface thereof as at 178 to provide mating surfaces during assembly. Preferably, seal strip 180 surrounds the mating joint to effect a weather seal between the building sections at this point. A similar sealing arrangement is achieved between the monolithic cap 22 and the second stage shell 20. The circumferentially spaced webs or fins 160 function to resist forces developed from the contraction of the pyramidal components, the tension of the rod and the deflection of the ceiling plate 170 as the components are drawn together by the mechanical threading of the components together at opposed ends of the fiberglass rod 150.

Reference to FIG. 8 shows a modification wherein the second stage shell 20 is replaced by a full cone 20′ which terminates in an upper end which conforms to the internal configuration of the monolithic cap 22 and wherein an opening 181 of a size approximating that of the diameter of the rod 150 is provided such that the rod protrudes through this hole 180 and permits its threaded end 152 to be threadably received within threaded hole 156 of cap 22. At the opposite end of the rod 150, threaded portion 154 passes through hole 158 within the ceiling disc 160 and is threaded to both ceiling plate 170 and lock nut 174. Further, in this case, the lower end of the intermediate cone 20′ terminates in a female connector 46′, while the upper end of panels 14 terminate in male connectors 28′. It is noted in FIG. 8 that the female connector 46′ is in the form of a two part slot having an entry portion 182 adjacent edge 190 which is wider than a narrowed terminal portion 184 which is separated therefrom by a tapered sidewall portion 185, while the male connector 46′ comprises a correspondingly configured projection including an entry portion 194 narrower than trailing portion 196, forming a weatherproof, watertight connection which is also impervious to gaseous fluids.

Reference to FIG. 9 illustrates a further modification of the invention, wherein the teepee building structure of the present invention terminates essentially in a single cap 22′ whose lower edge 190 is provided with a female connector 46′ which cooperatively receives the male connector 28′ of the upper end of base assembly 10, while a fiberglass rod 150 threaded at the top at 152 threadably engages cap 22′ at threaded hole 156, and its lower end projects through opening 158 within the center of the ceiling disc 160 and is threaded to ceiling plate 170 and nut 174 respectively.

Instead of using a connecting rod to join the cap to the base assembly, via an intermediate or second stage shell as desired, a rotary connection may be achieved for interlocking these two parts somewhat in the manner of the floor disc to the remaining portion of the floor assembly. In this respect, reference to FIG. 10 shows base assembly 10′ terminating at its upper end with each side wall and/or corner beam terminating in a flange 202 having a curved inner edge which defines a circular opening 204. Projecting radially inwards at spaced circumferential positions are radial locking projections 206. Further, the upper end 208 of the flanges are recessed at their inner peripheries to form an annular ledge 210. The cap 22″ terminates at its lower end 212 in a peripheral recess 214 forming surface 213 which rests on surface 208 of the base assembly 10' and an annular sidewall 216 which abuts the oppositely facing annular sidewall 218 of base assembly 10'. In addition, the cap 22' is provided at spaced circumferential positions corresponding to the locking projections or tabs 206, with fingers 220 each being provided with a circumferential slot 222 within one side thereof, of a size and configuration conforming to locking tabs 206. Thus, when the cap is dropped into place on the base assembly 10', the depending locking fingers 220 fall to one side of the radial locking tabs 206, but by rotating the cap clockwise in FIG. 10 as indicated by the arrow, the radial locking tabs are received within the slots 222 of the locking finger and the cap 22' is prevented from being removed vertically from base assembly 10' without the expedient of prior counterclockwise rotation to release the interlocking relationship between fingers 220 and table 206.

The full assembly and make-up of the completed building structure in teepee form may be readily appreciated by the above description in terms of the embodiments illustrated or in terms of the embodiments illustrated or in terms of modifying those embodiments by incorporating features within one embodiment and employing it with another. Once interlocked, the assembly cannot be disassembled except by substantially reversing the assembly procedure heretofore described. The floor assembly may be suitably anchored to a prepared building site such as a concrete slab or piling or simply placed on a prepared earth surface. Plumbine and electrical fixtures may be added in accordance with the desired utilization of the structure, or the fixtures may be incorporated in the preformed modular units prior to assembly and interconnecting mechanically during the mechanical interconnection of the modular units.

Figure 11:
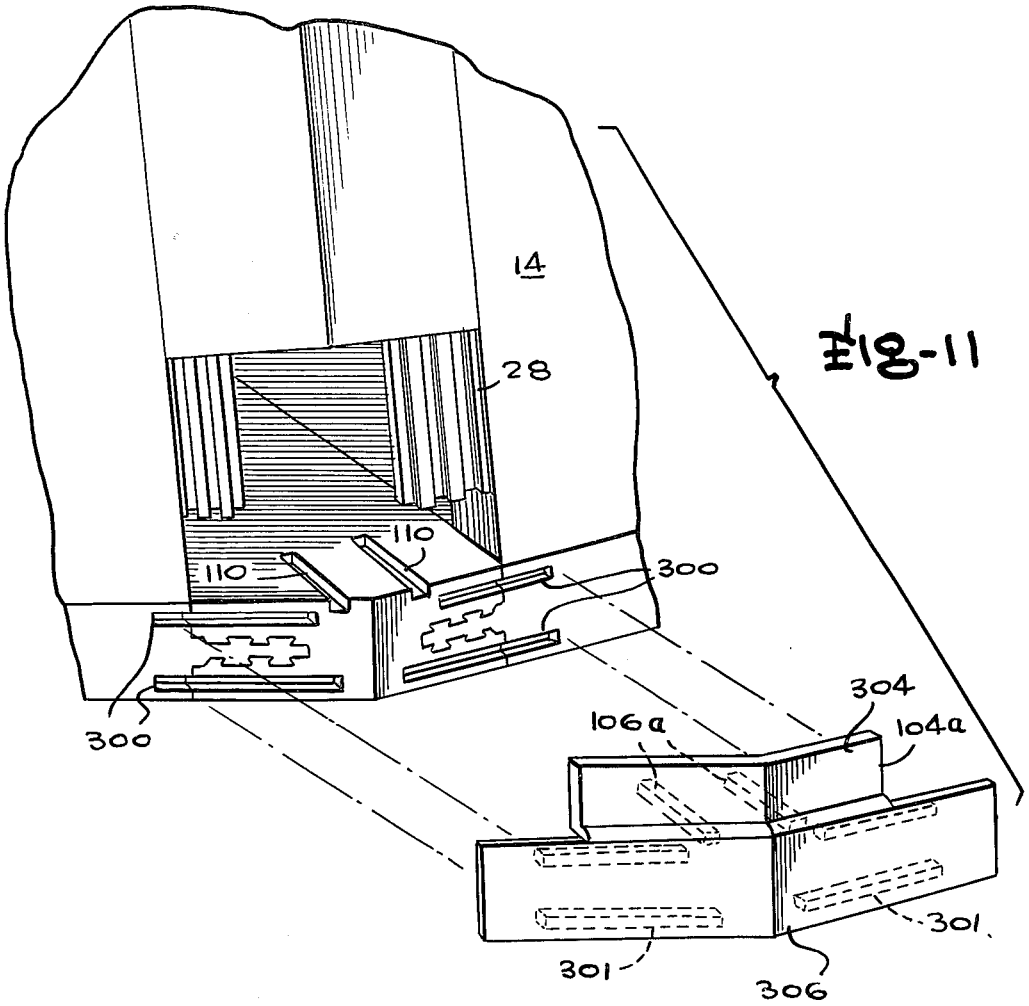
FIG. 11 is a perspective view in disassembled form of a modification showing a corner connection.

FIG. 11 discloses an alternative and preferred form of corner plug and corner structure. Here, the sidewall panels 14 are in place on the floor assembly 12, and a corner bar 16 is shown in process of installation. The floor assembly has lateral grooves 110*a* in its upper surface. Formed in the outer side edges of the floor assembly are substantially rectangular indentations 300*a*. A corner plug 104*a* is angled similar to the corner beam 16 and includes an upper plate section 304 and an outwardly extended lower plate section 306. A pair of mounting bars 1062 extend in substantially right angular relation to the general crosswise extent of the plug for sliding engagement into the grooves 110*a*. Lateral plug bars 301 are mounted on the inside of the lower plate section 306 and engage in the indentations 300*a*. This arrangement aids in achieving the functions of moisture exclusion, airtightness, and avoidance of condensation at the point of floor connection.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A prefabricated, modular building structure of teepee form comprising:

a frusto-pyramidal base assembly including a floor assembly of regular polygonal form plan configuration, said floor assembly consisting of at least two sets of end-to-end abutting panels interconnected by integral male and female connectors along opposed edges thereof, said sets of panels being joined together along respective sides by floor beams to integral, interengaging male and female connectors extending along respective sides thereof, and said base assemblies further comprise side panels removably coupled to the peripheral edges of the floor assembly and extending upwardly and inwardly thereof, said side panels being trapezoidal in configuration and being affixed to said floor assembly along respective edges and being joined together by corner beams with the side edges of the corner beams and the side edges of the side panels being formed with integral male and female connectors respectively and being interengaged, at least a pyramidal cap coupled to the upper end of said base assembly and acting as an extension thereof, said floor assembly comprising a regular polygon, said side panels at their bottoms being of a width correlated thereto and extending upwardly from respective side edges thereof and said corner beams being of shallow V-shaped cross-sectional configuration and being removably fixed to said base assembly side walls at respective corners of the polygonal floor assembly, a unitary frustopyramidal second stage shell resting its lower edge on the upper edge of the base assembly and receiving said pyramidal cap, and a threaded coupling extending through said second stage shell and being coupled at one end to said cap, and at the other end to a sealing disc spanning the upper end of said base assembly and having its periphery in engagement with the side panels of said base assembly below the area of contact between said base assembly and said second stage shell edges.

2. The building structure as claimed in claim 1, wherein said ceiling disc comprises a plurality of circumferentially spaced, integral webs extending upwardly from the top of said sealing disc and beyond the peripheral upper edge of said base assembly side panels and having radial edges conforming to the sidewalls of the frusto-pyramidal base assembly and the sidewall of said frusto-pyramidal second stage shell to facilitate the positioning of said second stage shell on said base assembly.

3. The building structure as claimed in claim 2, wherein said ceiling disc is apertured at its center, said threaded means for mechanically coupling said cap to said base assembly comprises a fiberglass rod threaded at both ends, said cap is internally threaded at its center and threadably receives one end of said fiberglass rod and said building structure further comprises a ceiling plate which lies beneath the ceiling disc, and is threadably coupled to the opposite end of said fiberglass rod, whereby rotation of said rod relative to said cap and said threaded ceiling plate, causes said cap, said second stage shell and said base assembly to move vertically into coupling engagement.

4. A prefabricated, modular building structure of teepee form comprising:

a frusto-pyramidal base assembly including a floor assembly of regular polygonal form plan configuration, said floor assembly consisting of at least two sets of end-to-end abutting panels interconnected by integral male and female connectors along opposed edges thereof, said sets of panels being joined together along respective sides by floor beams to integral, interengaging male and female connectors extending along respective sides thereof, and said base assemblies further comprise side panels removably coupled to the peripheral edges of the floor assembly and extending upwardly and inwardly thereof, said side panels being trapezoidal in configuration and being affixed to said floor assembly along respective edges and being joined together by corner beams with the side edges of the corner beams and the side edges of the side panels being formed with integral male and female connectors respectively and being interengaged, at least a pyramidal cap coupled to the upper end of said base assembly and acting as an extension thereof, said floor assembly comprising a regular polygon, said side panels at their bottoms being of a width correlated thereto and extending upwardly from respective side edges thereof and said corner beams being of shallow V-shaped cross-sectional configuration and being removably fixed to said base assembly side walls at respective corners of the polygonal floor assembly, said base assembly terminates at its upper end in an inwardly directed flange forming a circular opening, said flange is recessed on the upper edge of its periphery to form an annular ledge, a plurality of radial locking tabs project radially inward at circumferentially spaced locations on said ledge and said cap includes a recess within the periphery of the same at the lower edge thereof to define opposed annular contact surfaces between said cap and said base assembly, and said cap further comprises depending locking fingers on the inner periphery thereof along the bottom edge which extend below said edge, and said depending locking fingers have slots on one side thereof of a size and configuration corresponding to said radial locking tabs and being circumferentially positioned at positions with respect thereto such that placement of said cap on said base assembly and rotation of the cap relative thereto causes said locking tabs to enter said locking finger slots to resist vertical movement of said cap relative to said base assembly.

5. A prefabricated, modular building structure of teepee form comprising:

a frusto-pyramidal base assembly including a floor assembly of regular polygonal form plan configuration, said floor assembly consisting of at least two sets of end-to-end abutting panels interconnected by integral male and female connectors along opposed edges, thereof, said sets of panels being joined together along respective sides by floor beams to integral, interengaging male and female connectors extending along respective sides thereof, and said base assemblies further comprise side panels removably coupled to the peripheral edges of the floor assembly and extending upwardly and inwardly thereof, said side panels being trapezoidal in configuration and being affixed to said floor assembly along respective edges and being joined together by corner beams with the side edges of the corner beams and the side edges of the side panels being formed with integral male and female connectors respectively and being interengaged, at least a pyramidal cap coupled to the upper end of said base assembly and acting as an extension thereof, said floor assembly comprising a regular polygon, said side panels at their bottoms being of a width correlated thereto and extending upwardly from respective side edges thereof and said corner beams being of shallow V shaped cross-sectional configuration and being removably fixed to said base assembly side walls at respective corners of the polygonal floor assembly, a unitary frusto-pyramidal second stage shell resting its lower edge on the upper edge of the base assembly and receiving said pyramidal cap, and a threaded coupling extending through said second stage shell and being coupled at one end to said cap, and at the other end to a sealing disc spanning the upper end of said base assembly and having its periphery in engagement with the side panels of said base assembly below the area of contact between said base assembly and said second stage shell edges.

6. The building structure as claimed in claim 5, wherein said ceiling disc comprises a plurality of circumferentially spaced, integral webs extending upwardly from the top of said sealing disc and beyond the peripheral upper edge of said base assembly side panels and having radial edges conforming to the sidewalls of the frusto-pyramidal base assembly and the sidewall of said frusto-pyramidal second stage shell to facilitate the positioning of said second stage shell on said base assembly.

7. The building structure as claimed in claim 6, wherein said ceiling disc is apertured at its center, said threaded means for mechanically coupling said cap to said base assembly comprises a fiberglass rod threaded at both ends, said cap is internally threaded at its center and threadably receives one end of said fiberglass rod and said building structure further comprises a ceiling plate which lies beneath the ceiling disc, and is threadably coupled to the opposite end of said fiberglass rod, whereby rotation of said rod relative to said cap and said threaded ceiling plate, causes said cap, said second stage shell and said base assembly to move vertically into coupling engagement.

8. The building structure as claimed in claim 7, wherein at least the bottom edge of said second stage shell and the top edge of said base assembly includes interengaging male and female couplers to facilitate a weatherproof seal between said members during threaded engagement of said rod to said plate and said cap.

9. A prefabricated, modular building structure of teepee form comprising:

a frusto-pyramidal base assembly including a floor assembly of regular polygonal form plan configuration, said floor assembly consisting of at least two sets of end-to-end abutting panels interconnected by integral male and female connectors along opposed edges thereof, said sets of panels being joined together along respective sides by floor beams through integral, interengaging male and female connectors extending along respective sides thereof, and said base assembly further comprises side panels removably coupled to the peripheral edges of the floor assembly and extending upwardly and inwardly thereof, said side panels being trapezoidal in configuration and being affixed to said floor assembly along respective edges and being joined together by corner beams with the side edges of the corner beams and the side edges of the side panels being formed with integral male and female connectors respectively and being interengaged, at least a pyramidal cap coupled to the upper end of said base assembly and acting as an extension thereof, the periphery of said floor assembly includes a plurality of radially spaced rectangular slots, said slots include circumferentially enlarged sections at their vertically lower ends to one side thereof and said base assembly further comprises elongated side panel connectors including a horizontal base portion having a plurality of L-shaped shoes projecting downwardly therefrom at positions corresponding to the slots on the periphery of said floor assembly and said side panel connectors further comprise a male connector extending upwardly therefrom and oblique with respect thereto, for receiving the female connector at the bottom edge of a corresponding side panel during assembly of the side panel to the floor assembly, the periphery of said floor assembly further comprises at each corner grooves extending at right angles to said slots and intersecting the same and said base assembly further comprises corner plugs, each comprising vertical plate portions joined together to define a shallow V therebetween and mounting bars fixed to respective plates and extending parallel to each other and generally at right angles to said plate along the lower edge thereof, said mounting bars being spaced and of a configuration corresponding to the lateral grooves within the periphery of said floor assembly at each corner and being received thereby such that the sides of the corner plug abut respective side plates at a given corner and the plugs are coplanar with respective portions of the shallow V corner beams interconnecting the opposed edges of respective side plates.

10. A prefabricated, modular building structure of teepee form comprising:

a frusto-pyramidal base assembly including a floor assembly of regular polygonal form plan configuration, said floor assembly consisting of at least two sets of end-to-end abutting panels interconnected by integral male and female connectors along opposed edges thereof, said sets of panels being joined together along respective sides by floor beams through integral, interengaging male and female connectors extending along respective sides thereof, and said base assembly further comprises side panels removably coupled to the peripheral edges of the floor assembly and extending upwardly and inwardly thereof, said side panels being trapezoidal in configuration and being affixed to said floor assembly along respective edges and being joined together by corner beams with the side edges of the corner beams and the side edges of the side panels being formed with integral male and female connectors respectively and being interengaged, at least a pyramidal cap coupled to the upper end of said base assembly and acting as an extension thereof, said floor assembly comprises a rectangular polygon in plan configuration and comprises a plurality of arcuate panels end connected by interspersed beams and being connected therebetween by integral male and female connectors along the sides of said beams and the respective ends of said arcuate panel, said beams and said arcuate panels define a circular hole with the center of the same, the periphery at said circular hole being recessed on the upper surface thereof to form an annular ledge, said annular ledge having axially extending rectangular slots within the same at circumferentially spaced locations, said rectangular slots including circumferentially enlarged slot portions to one side thereof at the bottom of said floor assembly, and wherein said floor assembly further comprises a floor insert disc of a diameter corresponding to that of the peripheral recess and having a thickness corresponding to the depth of said recess, and wherein a plurality of circumferentially spaced L-shaped shoes depend from the bottom of said floor insert disc adjacent the periphery thereof and are positioned such that when said disc is positioned within the circular hole and rotated, the shoes move into said rectangular slots within said ledge and upon further rotation cause the horizontal extension portions of said shoes to move into the extension portions of said slots to effect a bayonet coupling between said floor insert disc and the peripheral portion of said floor assembly.

11. The building structure as claimed in claim 10, wherein said disc is provided with a rectangular opening within the center of the same whereby the placement of a rectangular projection of a T-shaped turning tool within said rectangular center hole of said floor insert disc permits said tool to rotate said floor insert disc to align said shoes with said ledge slots and to effect by further rotation locking of said insert disc within said floor assembly peripheral portion.

12. The building structure as claimed in claim 10, further comprising a plurality of locking pins equal in number to said slots within said ledge and of a configuration and size corresponding to said slots and said shoes, and received with said slots after insertion of said shoes and to the side opposite that of said shoe extensions to prevent further rotation of said floor insert disc with respect to said floor assembly while the circumferential extension portions of said shoe prevent vertical movement of said inserted disc.

13. A prefabricated, modular building structure of teepee form comprising:

a frusto-pyramidal base assembly including a floor assembly of regular polygonal form plan configuration, said floor assembly consisting of at least two sets of end-to-end abutting panels interconnected by integral male and female connectors along opposed edges thereof, said sets of panels being joined together along respective sides by floor beams through integral, interengaging male and female connectors extending along respective sides thereof, and said base assembly further comprises side panels removably coupled to the peripheral edges of the floor assembly and extending upwardly and inwardly thereof, said side panels being trapezoidal in configuration and being affixed to said floor assembly along respective edges and being joined together by corner beams with the side edges of the corner beams and the side edges of the side panels being formed with integral male and female connectors respectively and being interengaged, at least a pyramidal cap coupled to the upper end of said base assembly and acting as an extension thereof, the periphery of said floor assembly includes a plurality of radially spaced rectangular slots, said slots include circumferentially enlarged sections at their vertically lower ends to one side thereof and said base assembly further comprises elongated side panel connectors including a horizontal base portion having a plurality of L-shaped shoes projecting downwardly therefrom at positions corresponding to the slots on the periphery of said floor assembly and said side panel connectors further comprise a male connector extending upwardly therefrom and oblique with respect thereto, for receiving the female connector at the bottom edge of a corresponding side panel during assembly of the side panel to the floor assembly, the periphery of said floor assembly further comprises at each corner grooves extending at right angles to said slots in a series of indentations in the outer side edges thereof, said grooves intersecting the slots and the base assembly further comprises corner plugs, each comprising vertical plate portions having upper and lower sections and the plate portions being joined together to define a shallow V therebetween and mounting bars fixed to respective upper portions of the plates and extending parallel to each other and generally at right angles to said plate along the lower edge thereof, said mounting bars being spaced in a configuration corresponding to the lateral groove within the periphery of said floor assembly at each corner and being plugs abut respective side the sicles of the corner plugs abut respective side plates at a given corner and the plugs are co-planar with respective portions of the shallow V corner beams interconnecting the opposed edges of respective side plates, and lateral plug bars on the lower sections of the corner plates engaging in the indentations of the outer side edges of the floor assembly.

* * * * *